US005325792A

United States Patent [19]

Mulloy

[11] Patent Number: 5,325,792

[45] Date of Patent: Jul. 5, 1994

[54] BOOKSHELF WITH ADJUSTABLE LOCKING BOOKENDS

[76] Inventor: Bernard J. Mulloy, 2092 128th Ave., Hopkins, Mich. 49328

[21] Appl. No.: 943,776

[22] Filed: Sep. 11, 1992

[51] Int. Cl.[5] ..... A47B 65/00

[52] U.S. Cl. ..... 108/28; 211/43

[58] Field of Search ..... 211/42, 43, 184, 11, 211/162; 108/60, 61, 28; 248/297.2, 298, 499

[56] References Cited

U.S. PATENT DOCUMENTS

| | | | |
|---|---|---|---|
| 113,830 | 4/1871 | Anderson | 211/43 X |
| 2,569,622 | 10/1951 | Trainor | 248/297.2 X |
| 2,684,765 | 7/1954 | Lowenstein, Jr. | 211/43 |
| 3,138,262 | 6/1964 | Anders | 211/43 |
| 3,465,896 | 9/1969 | Cafiero et al. | 211/184 |
| 3,487,945 | 1/1970 | Barham | 211/43 |
| 4,113,108 | 9/1978 | Anderson | 211/43 |
| 4,682,696 | 7/1989 | Shey | 211/43 |
| 4,874,099 | 10/1989 | Arnott et al. | 211/50 |
| 4,878,640 | 11/1989 | Fricker et al. | 248/297.2 |
| 5,154,385 | 10/1992 | Lindberg et al. | 248/297.2 X |

*Primary Examiner*—Clifford D. Crowder
*Assistant Examiner*—Paul C. Lewis
*Attorney, Agent, or Firm*—Basile and Hanlon

[57] ABSTRACT

A bookshelf has a guideway formed longitudinally therein. A channel structure is attached to the shelf within the guideway and includes at least one row of spaced, open-ended apertures. A base is connected to a planar book support member and has a movable lock bar extending therethrough. A cross bar is attached to a second end of the lock bar and is urged by a biasing spring engaging the second end of the lock bar to a first position in which the cross bar is securely engaged in one of the apertures in the channel structure to lock the base and the attached book support member in a selected position along the length of the shelf. One and preferably two identically constructed bases and attached book support members, each having a lock bar mounted in each base, are adjustably and lockingly positioned on the shelf.

19 Claims, 9 Drawing Sheets

BOOKSHELF WITH ADJUSTABLE LOCKING BOOKENDS

BACKGROUND OF THE INVENTION

1. Field of the Invention

The present invention relates, in general, to book holding devices and, specifically, to book holders for supporting books, files, papers and the like on a shelf and, more specifically, to adjustable book holders which are movably and lockingly positionable along a bookshelf.

2. Description of the Art

Bookshelves are extensively used to support books, files, magazines, folders and the like in a generally upright, side-by-side position with the spine or edges of such books extending upward from the shelf. The shelf itself is typically a horizontal member extending between two fixed end walls which may be part of the elongated side walls of a bookcase which supports a number of vertically spaced, horizontal shelves.

Frequently, and sometimes intentionally, fewer books than the total number of books which would fill the shelf, are placed on the shelf between the two end walls. In order to maintain such books in a generally upright position, at least one bookend is placed on the shelf and brought into engagement with the end(s) of the horizontal row of books to support the books in an upright position. Such bookends can be free-standing so as to be easily positionable anywhere along the length of the bookshelf. However, such free-standing bookends are typically large and heavy so as to provide adequate support for the books. Such large size or weight, however, make such bookends difficult to easily move along the shelf.

Thus, lockable bookends have been devised which slide along tracks formed in the shelf to any position along the shelf and are locked in a desired position tightly against the end of a horizontal row of books. The lock means employed in such adjustable bookends must meet a number of different functions.

First, the lock means must be strong enough to securely retain the bookend in a fixed place despite the weight of the row of books, files, etc., pushing thereon without permitting movement of the bookend. Secondly, the lock means must be easily releasable, preferably by finger pressure, to enable anyone to easily unlock and move the bookend to another position along the bookshelf. Thirdly, the adjustable bookend must be simple in construction for a low manufacturing cost, ease of installation and long term, reliable use. Previously devised adjustable bookends have not sufficiently met all of these functions.

Thus, it would be desirable to provide an adjustable bookend which overcomes substantially all of the problems of previously devised adjustable bookends. It would also be desirable to provide an adjustable bookend which is simple in construction for a low manufacturing cost. It would also be desirable to provide an adjustable bookend which is securely lockable in place, yet can be easily released for repositioning along a bookshelf. It would also be desirable to provide a bookshelf with adjustable bookends in kit form for assembly with a variety of different types of bookshelves.

SUMMARY OF THE INVENTION

The present invention is a bookshelf with at least one lockingly adjustable bookend mounted thereon. The shelf has top and bottom surfaces. A guideway extends through the shelf longitudinally along the shelf. A channel means is attached to the shelf and includes a longitudinally extending, open-ended slot aligned with the guideway in the shelf. A plurality of spaced, open-ended apertures are co-linearly formed longitudinally along the channel means.

A base is attached to a generally planar book support member and is slidably along the length of the shelf. A lock means is mounted in the base and has a lock bar accessible at one end of the base for manual movement of the lock bar through the base. A second end of the lock bar extends through the base and the guideway into the slot in the channel means. A cross bar is mounted on the second end of the lock bar and releasably engages one of the apertures in the channel means to lockingly retain the base and the book support member attached thereto in a selectively adjustable position along the length of the shelf. Biasing means acts on the lock bar to normally bias the lock bar and the attached cross bar to a first position in which the cross bar engages one of the apertures in the channel means.

In a preferred embodiment, two identically constructed bases and book support members, each having a lock means mounted therein, are adjustably positioned on the bookshelf and are each movable to a selectively adjustable position along the shelf to support books and the like therebetween.

In one embodiment, the shelf comprises first and second shelf members which are spaced apart to define the guideway therebetween. The channel means includes one spine channel connected to the first shelf member and another spine channel connected to the second shelf member. Each spine channel has a central wall integrally formed between the two legs thereof. The central wall is oriented in a substantially planar, aligned configuration with the top surface of the associated shelf member, with the first leg of each spine channel securely connected to the side edge of the shelf member between the top and bottom surfaces thereof.

A link channel has a generally U-shape with a central wall disposed between two spaced legs extending outward therefrom. Means are provided for joining one of the legs of the link channel to the first leg of each spine channel to securely join the pair of spine channels and the attached first and second shelf members together in a spaced arrangement about the longitudinal guideway.

In this embodiment, fasteners are mounted in a side edge of each of the first and second shelf members and extend outward thereof. The first leg of each spine channel is mounted to the associated first or second shelf member by means of the fasteners. L-shaped slots are formed in the legs of the link channel and are slidably engageable with the fasteners to securely mount the link channel to the spine channels and the connected first and second shelf members.

In another embodiment, the channel means comprises an extruded plastic channel structure formed of an upper channel member and a lower channel member which may be integrally formed as a unitary one-piece structure, or as separate members which are fixedly joined together and mounted between adjacent portions of the shelf forming the guideway through the shelf. Preferably, the upper channel member is formed of two, identical spine channels having an outer side leg joined to the lower channel member and an inner depending leg spaced from the inner depending leg of the opposed upper channel member which forms the slot therebetween. The open-ended apertures are formed in each of the depending legs. Preferably, the upper and lower channel members are formed of an extruded plastic material. A keeper is mounted between the upper and lower channel members and is connected via a central stem extending through the slot in the upper channel member to the base.

The bookshelf with adjustable locking bookends of the present invention provides a unique arrangement for supporting books and the like which has many significant advantages over previously devised shelf with adjustable bookends. The shelf with adjustable bookends of the present invention is of simplified construction for a low manufacturing cost, ease of use and long term reliability. The adjustable bookends include a lock means which provides a sufficient force to securely retain the bookends in a selected position along the bookshelf to support books in a generally upright position on the shelf; yet, at the same time, is easily releasable, such as by finger pressure, to enable repositioning of the bookend along the shelf.

The adjustable bookends and associated shelf connecting elements of the present invention may be provided in kit form to enable the adjustable bookends and the associated connecting elements to be used with a variety of different types of shelf members including shelf members made of metal, wood, laminated wood core, etc.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
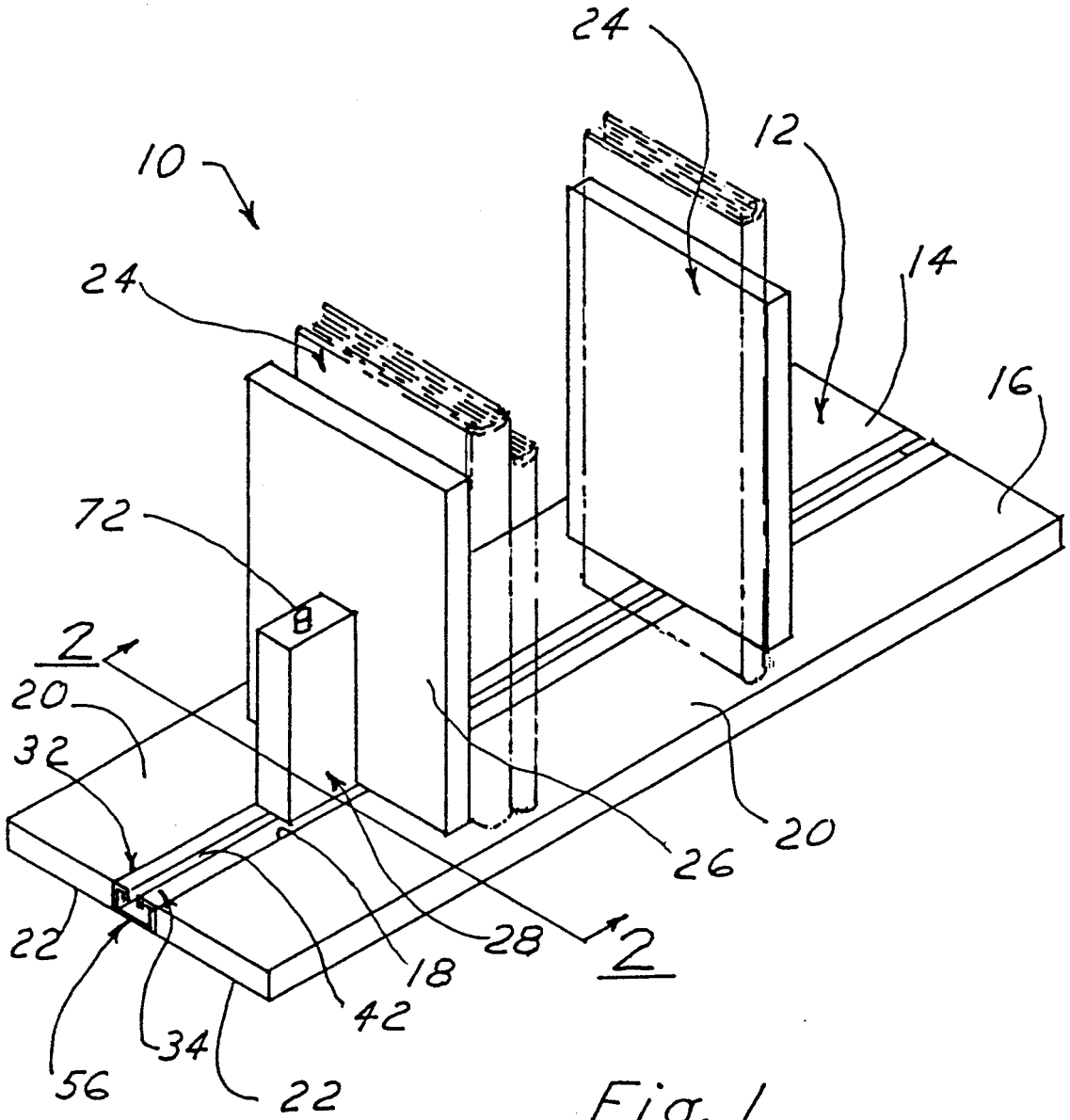
FIG. 1 is a perspective view of bookshelf with adjustable bookends constructed in accordance with the teachings of one embodiment of the present invention.

Referring now to the drawing, and to FIG. 1 in particular, there is illustrated a bookshelf with adjustable locking bookends constructed in accordance with the teachings of one embodiment of the present invention. The combined bookshelf with adjustable bookends, denoted generally by reference number 10, is designed to hold books in a generally upright position. The term "books" means books, both hardcover and paperback, magazines, files of any type, phonograph records, photo albums and the like. The term "bookshelf", as used herein, means a horizontal surface used to support books in a generally upright, side-by-side position. The bookshelf may be stationarily mounted in a larger book case, free-standing and mountable on brackets attached to a wall, or portable so as to be removably placed on a movable cart, stand, desk, etc.

The combined bookshelf with adjustable bookends 10 includes a shelf 12 which, in one embodiment, is formed of a first shelf section 14 and a second identical shelf section 16. The first and second shelf sections 14 and 16 are of identical size and are spaced apart to form a guideway 18 therebetween. The first and second shelf sections 14 and 16 also have a top surface denoted by reference number 20 and an opposed bottom surface 22 with side edges extending therebetween.

The first and second shelf sections 14 and 16 may be formed of any suitable material, such as wood, plastic, metal, etc. In the embodiment shown in FIGS. 1 and 2, the first and second shelf sections 14 and 16 are formed of wood, such as natural wood or composite fiberboard which is covered by a plastic laminate of any color or pattern.

The combined bookshelf with adjustable bookends 10 includes at least one and preferably two adjustably positionable bookends, each denoted in general by reference number 24. As each of the bookends 24 is identically constructed, the following description will be provided with respect to only one of the bookends 24.

Figure 2:
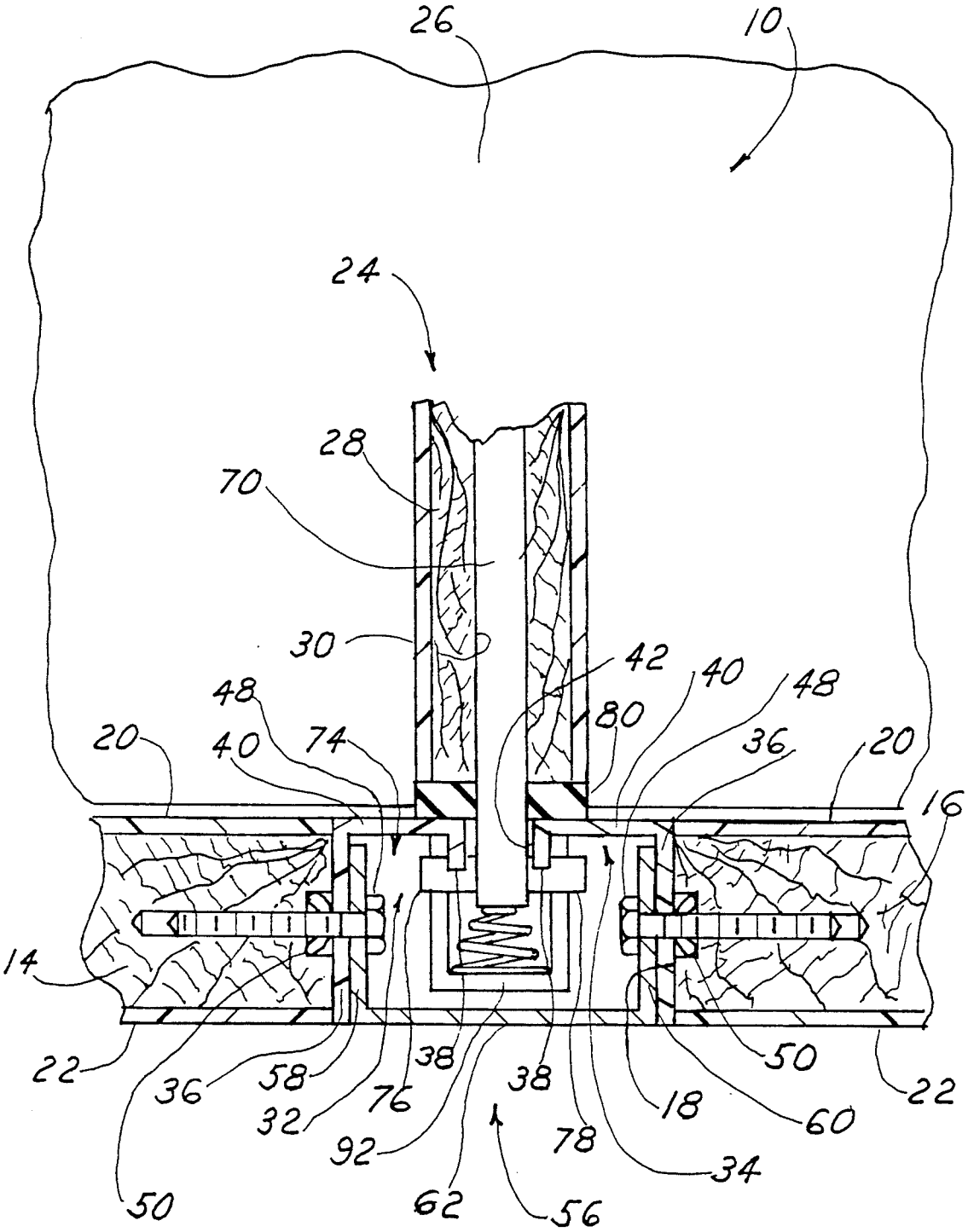
FIG. 2 is a cross sectional view generally taken along line 2—2 in FIG. 1.

As shown in FIGS. 1 and 2, the bookend 24 includes a generally planar book support member 26 which is disposed above the top surface 20 of the shelf 12. The book support member 26 has a generally rectangular shape, by way of example only, and may be formed of any suitable material, such as metal, wood, plastic laminate covered wood, etc.

Figure 4:
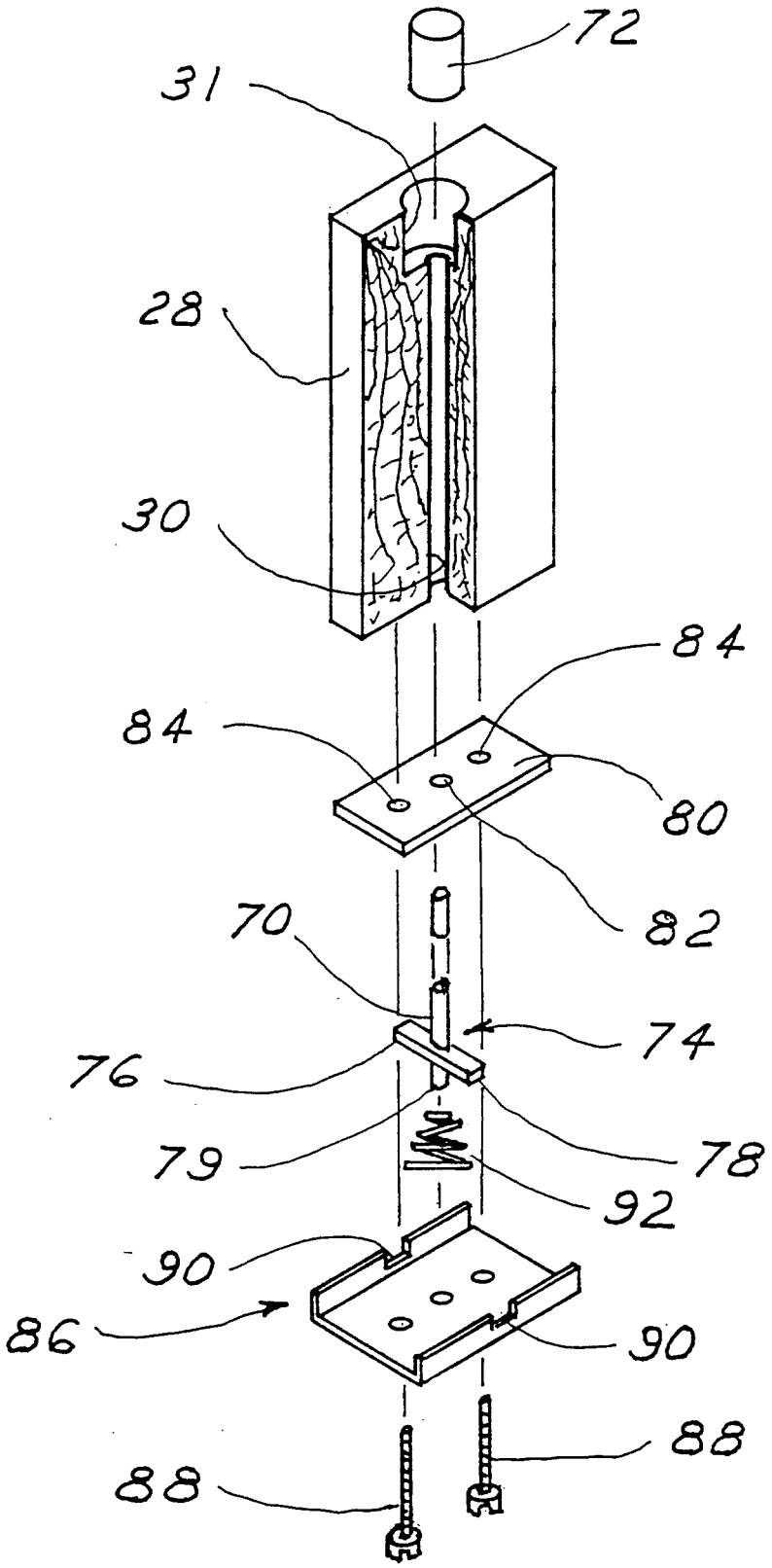
FIG. 4 is an exploded, perspective view showing the construction of the lock means of the present invention.

A base 28 is attached to one surface of the book support member 26 by any suitable means, such as fasteners, adhesive, etc. The base 28 has a generally rectangular, cubical shape and is likewise formed of metal, wood, plastic, laminate covered wood, etc. As shown in FIGS. 2 and 4, an elongated bore 30 is formed in and extends through the base 28 from the top to the bottom surfaces thereof. The bore 30 terminates in an enlarged diameter end 31 adjacent the top end of the base 28, as shown in detail in FIG. 4.

Figure 3:
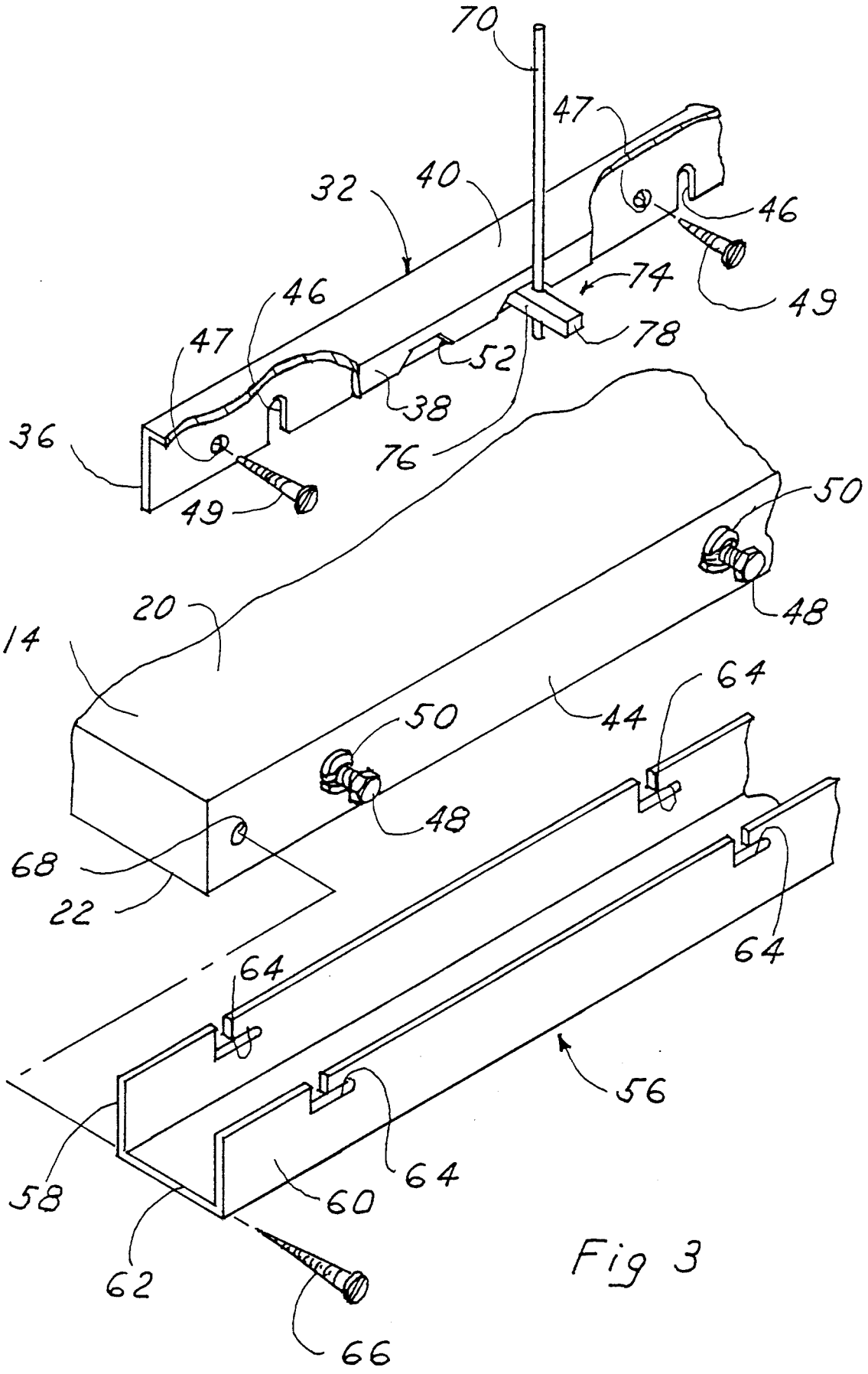
FIG. 3 is an exploded, perspective view showing the construction of the connecting elements used to attach the adjustable bookends to a bookshelf.

The combined bookshelf with adjustable bookends 10 of the present invention includes a lock means for releasably locking each of the bookends 24 in an adjustably selected position along the length of the shelf 12. As shown in FIGS. 2 and 3, the lock means includes identically constructed first and second spine channels 32 and 34, respectively. In this embodiment, each of the spine channels 32 and 34 has a generally U-shape formed of a first leg 36, a spaced second leg 38 and an integrally formed, central leg 40 disposed between and connected to one end of each of the legs 36 and 38. The second leg 38 is spaced from the first leg 36 and preferably has a shorter length than that of the first leg 36.

As shown in FIGS. 2 and 3, the first leg 36 of the first spine channel 32 is securely attached to a side edge 44 of the first shelf section 14 by means of suitable fasteners 48, such as flat head screws. A plurality of spaced open-ended slots 46 are formed in the first leg 36 of the first spine channel 32 and are slidably urged over fasteners 48 which have been previously threaded into bores extending inward from the side edge 44 of the first shelf section 14. A disc spring washer 50 is mounted about the fastener 48 between the side edge 44 of the first shelf section 14 and the first leg 36 of the first spine channel 32 to exert a biasing force on the first spine channel 32 as described hereafter. When the first spine channel 32 is securely attached to the side edge 44 of the first shelf section 14, the top surface 40 of the first spine channel 32 is substantially co-planar or flush with the top surface 20 of the first shelf section 14. When the spine channel 32 is thusly located in the desired position, a plurality of spaced apertures 47 are drilled through the first leg 36 into the first shelf section 14. Flat head screws 49 are threaded through the apertures 47 into the first shelf section 14 to securely attach the spine channel 32 to the first shelf section 14.

It will be understood that an identical fastening arrangement is employed to attach the first leg 36 of the second spine channel 34 to the side edge of the second shelf section 16, as shown in FIG. 2. When the second spine channel 34 is attached to the second shelf 16, as shown in FIG. 2, the top surface 40 of the second spine channel 34 is likewise co-planarly arranged with the top surface 20 of the second shelf section 16. The second leg 38 of each of the first and second spine channels 32 and 34, respectively, is also spaced apart from the corresponding second leg of the other of the first and second spine channels 32 and 34 to form a slot denoted generally by reference number 42 therebetween.

Although the first and second spine channels 32 and 34 could be formed of any suitable material, such as metal, plastic, etc., in a preferred embodiment, the first and second spine channels 32 and 34 are formed of an extruded plastic, such as ABS, which is extruded into the particular shape shown in FIG. 3.

A plurality of spaced, open-ended apertures, denoted generally by reference number 52 in FIG. 3, are formed in and are spaced along the second leg 38 of each of the first and second spine channels 32 and 34. The apertures 52 may have any shape, such as a slot-like shape, or the illustrated angular side walled shape shown in FIG. 3. Further, the slots 52 may be provided at any desired spacing along the length of the first and second spine channels 32 and 34, such as, by way of example only, a ⅜-inch center-to-center spacing.

A link channel 56 is interconnected between the first and second spine channels 32 and 34. The link channel 56 has a generally U-shape formed of spaced first and second legs 58 and 60 which are interconnected by an integrally formed central leg or wall 62. A plurality of generally L-shaped slots 64 are formed along the length of and open to the upper edge of each of the legs 58 and 60 of the link channel 56. The slots 64 are designed to slidably fit around the fasteners 48 and include a vertical portion and a horizontal portion.

As shown in FIG. 3, the fasteners 48 are initially threaded into the side edge 44 of the first and second shelf sections 14 and 16 such that the head thereof extends outward from the side edge 44 of the corresponding shelf sections 14 and 16 a predetermined distance sufficient to snugly receive the first leg 36 of a spine channel 32 or 34 and one of the legs 56 or 60 of the link channel 56. The spring disc 50 provides a biasing force to securely retain the first leg 36 of one of the spine channels 32 or 34 and one of the legs 58 or 60 of the link channel 56 in secure engagement between the head of the fastener 48 and the side edge 44 of the first shelf section 14.

In the assembly of the combined bookshelf with adjustable bookends 10 of the present invention, the link channel 56 is attached to the fasteners 48 by engaging the slots 64 on the link channel 56 with the fasteners 48 such that the legs 58 and 60 of the link channel 56 are disposed between the heads of each of the fasteners 48 and an adjacent first leg 36 of the first and second spine channels 32 and 34, as shown in FIG. 2. After the first vertical portion of the slot 64 has been urged over the shaft of the fasteners 48, the link channel 56 is then slid horizontally along the length of the adjacent shelf sections 14 and 16 to bring the fasteners 48 into the end of the horizontally extending portion of each of the slots 64. A stop fastener 66 is then threadingly inserted into a bore 68 formed at one end of the first shelf section 14 to lock the link channel 56 in a fixed horizontal position with respect to the first and second shelf sections 14 and 16.

Prior to the assembly of the link channel 56 to the spine channels 32 and 34, an elongated lock bar 70 is slidably urged through the bore 30 in the base 28 of each of the bookends 24. A manual release button 72, shown in FIG. 1 and in greater detail in FIG. 4, is mounted on the upper end of the lock bar 70 and seats within the enlarged diameter end 31 of the bore 30 in the base 28 with an upper portion thereof extending outward above the top surface of the base 28 as shown in FIG. 1. The lock release button 72 is fixedly connected to the upper end of the lock bar 70 by a press fit, adhesive, or other suitable means.

By way of example only, the lock bar 70 is formed of a circular cross section metallic wire. A notch is formed adjacent a second end of the lock bar 70 and fixedly receives a cross bar 74 therein. The cross bar 74 preferably has a rectangular or square cross sectional shape with first and second ends 76 and 78 extending outward from opposite sides of the lock bar 70 as shown in FIGS. 2 and 4. The cross bar 74 is secured to the lock bar 70 by suitable means, such as welding, etc.

A rest pad 80, shown in FIGS. 2 and 4 is mounted on the bottom surface of the base 28 and the top surfaces 40 of the first and second spine channels 32 and 34. The rest pad 80 is formed of a suitable low friction material, such as rubber, to provide easy sliding movement of the base 28 along the spine channels 32 and 34 during selective positioning of the bookends 24 on the shelf 12. The rest pad 80 is provided with a central aperture 82 through which the lock bar 70 extends as well as a pair of spaced, outer apertures 84 which receive other fasteners as described hereafter.

As shown in FIGS. 2 and 4, a keeper 86 having a generally U-shape is disposed below the second end 79 of the lock bar 70 and is secured to the rest pad 80 and the base 28 by fasteners 88 which extend through apertures formed in the keeper 86 and the apertures 84 in the rest pad 80 into corresponding bores extending inward from the bottom surface of the base 28 of the bookend 24. Further, a pair of slots 90 are formed in each of the upstanding side walls of the keeper 86 for receiving the outer ends 76 and 78 of the cross bar 74 therein, as described hereafter.

The second end 79 of the lock bar 70 extends below the cross bar 74 and seats within a biasing means 92. The biasing means 92 is preferably in the form of a coil spring, having a generally increasing diameter conical shape, by way of example only, as is illustrated in FIG. 4. The biasing spring 92 seats between the second end 79 of the lock bar 70 and the keeper 86 and biases the lock bar 70 to a first position in which the lock release button 72 extends upward above the top surface of the base 28 of the bookend 24 and the outer ends 76 and 78 of the cross bar 74 mounted on the lock bar 70 engage one of the slots 52 in the second legs 38 of each of the first and second spine channels 32 and 34, as shown in FIGS. 2 and 3, to lockingly retain the bookend 24 in a selected position along the length of the shelf 12. However, a downward force exerted on the manual release button 72 overcomes the biasing force of the spring 92 and moves the ends 76 and 78 of the cross bar 74 out of the opposed slots 52 in the spine channels 32 and 34 thereby enabling the bookend 24 to be slid along the length of the shelf 12 to any other position at which time the manual release button 72 is released such that the biasing spring 92 urges the lock bar 70 upward causing the outer ends 76 and 78 of the cross bar 74 to again seat within other aligned slots 52 in the spine channels 32 and 34 to lock the bookend 24 in the new selected position on the shelf 12. The sloping side walls of the slots 52, as shown in FIG. 3, provide a self-centering function to enable the cross bar 74 to securely seat within a selected pair of aligned slots 52 in the spine channels 32 and 34 even if the cross bar 74 is not initially exactly centered in the aligned slots 52 in the spine channels 32 and 34.

Figure 5:
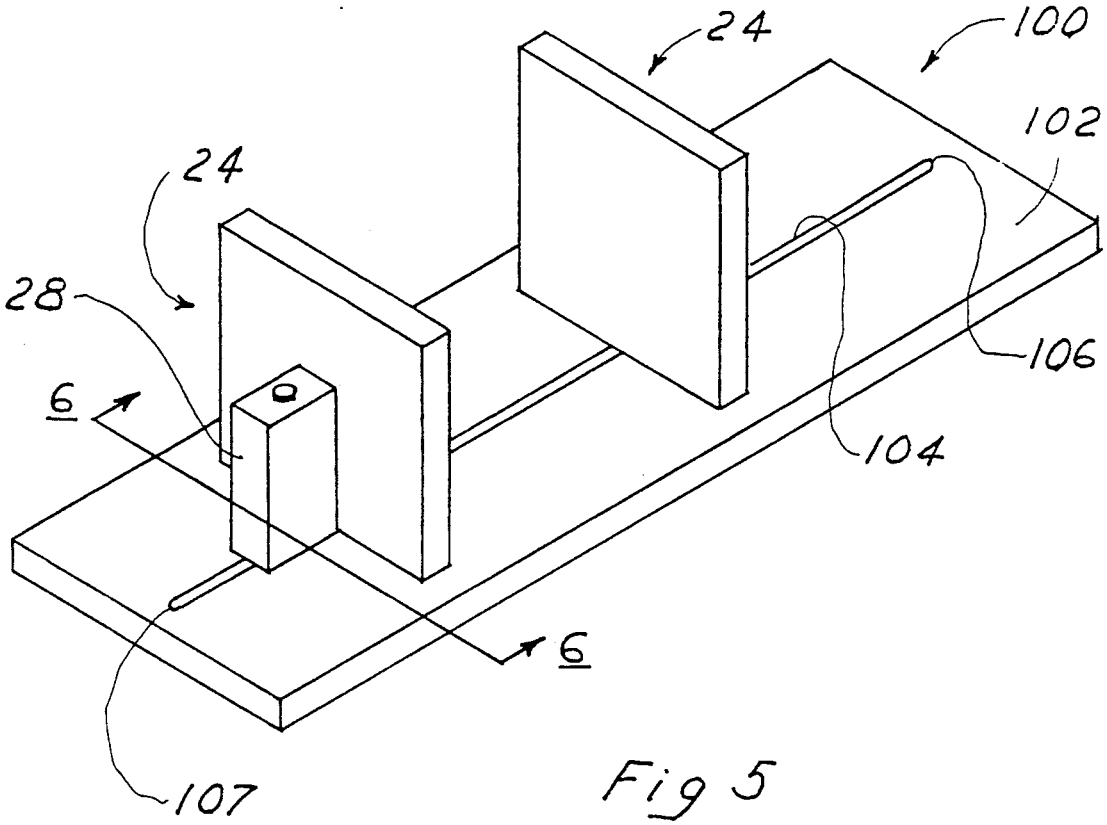
FIG. 5 is a perspective view of another embodiment of a bookshelf with adjustable bookends according to the present invention.
Figure 6:
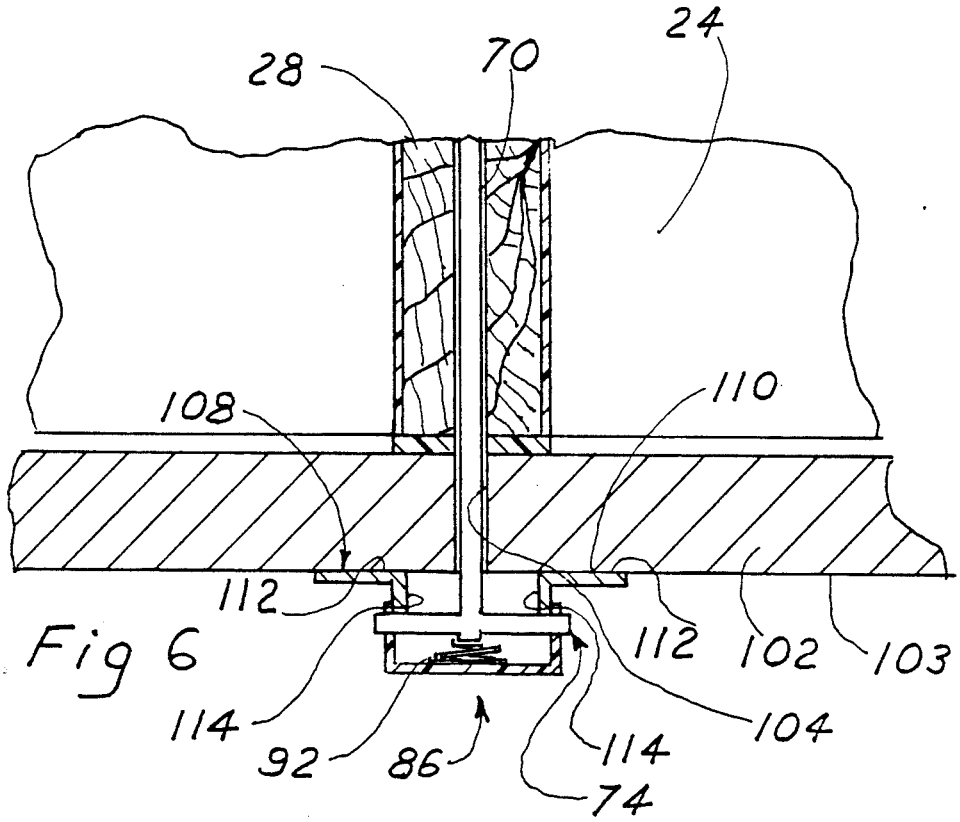
FIG. 6 is a cross sectional view generally taken along line 6—6 in FIG. 5.

Referring now to FIGS. 5 and 6, there is depicted another embodiment of a bookshelf with adjustable bookends which is denoted in general by reference number 100. In this embodiment, the bookends 24 are identically constructed as described above and are provided in at least one and preferably a pair on a shelf 102.

The shelf 102 is formed of a single-piece member of a suitable material, such as wood or, preferably, metal. An elongated guideway 104 is formed in the shelf 102 and has opposed ends 106 and 107 which are spaced from the corresponding outer side ends of the shelf 102 such that the guideway 104 is formed completely within the periphery of the shelf 102.

The lock bar 70, the keeper 86 and the biasing spring 92 are the same as described above and further details will not be provided for this embodiment of the present invention. The same reference numbers employed with such elements as described above are used with the same components shown in FIGS. 5 and 6.

However, in this embodiment, first and second spine channels 108 and 110 are securely mounted to the bottom surface 103 of the shelf 102 by means of suitable fasteners or, preferably, welding due to the preferred metal construction of the shelf 102 and the spine channels 108 and 110. Each of the first and second spine channels 108 and 110 has a first leg 112 which is designed to engage and be secured to the bottom surface 103 of the shelf 102 by welding or other suitable fasteners. A second leg 114 depends from one end of the first leg 112 of each of the spine channels 108 and 110 and has slots identical to the slots 52 described above formed therein for selectively receiving the outer ends of the cross bar 74 mounted on the lock bar 70 to selectively position the bookend 24 along the length of the shelf 102 in the same manner as that described above in the first embodiment of the present invention.

Figure 9:
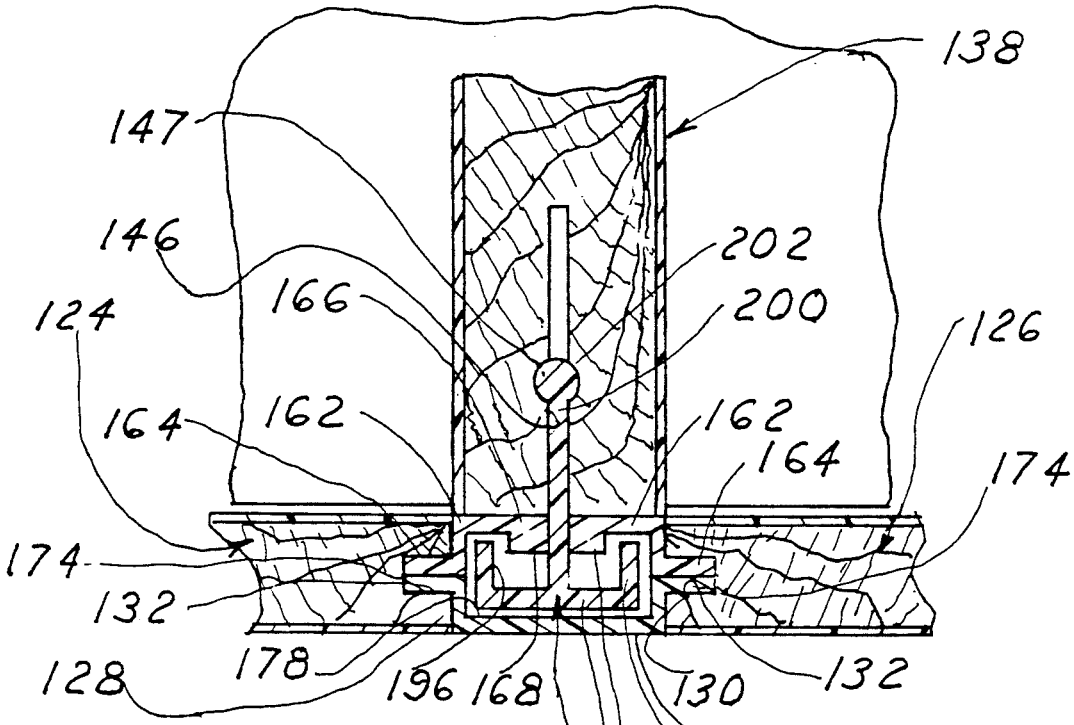
FIG. 9 is a cross sectional view generally taken along line 9—9 in FIG. 8.

Referring now to FIGS. 7–11, there is illustrated a third embodiment of the present bookshelf 120 with adjustable locking bookends. The bookshelf 120 includes a shelf 122 formed of first and second, substantially identical sections 124 and 126. The shelf sections 124 and 126 are of substantially identical in size and are spaced apart to form a guideway therebetween. The first and second shelf sections 124 and 126 may be formed in the same manner as in the first embodiment of the present invention described above, such as from wood or composite fiberboard which is covered by a plastic laminate. In a preferred method of construction, the shelf 122 is constructed in the desired length and at a double width, equal to the combined widths of the first and second shelf sections 124 and 126. The shelf 122 is then laminated with a thin layer of plastic laminate on all exterior surfaces. The shelf 122 is then cut along a longitudinal center line to form the two shelf sections 124 and 126 which are laminated on three exterior surfaces, but not on interior facing surfaces 128 and 130, as shown in FIG. 9. As shown in FIG. 9, an open-ended slot 132 is formed in the inner facing edges 128 and 130 of each of the shelf sections 124 and 126, respectively.

The bookshelf 120 also includes at least one and, preferably, two adjustably positionable bookends, each denoted by reference number 134. Each of the bookends 134 is formed of a planar book support member 136 which is substantially identical to the book support member 26 described above and shown in FIG. 1. The book support member 136 is also preferably laminated with a suitable plastic laminate.

A base 138, also covered with an exterior layer of a plastic laminate, is attached to one surface of each book support member 136 by means of suitable fasteners, adhesives, etc.

Figure 8:
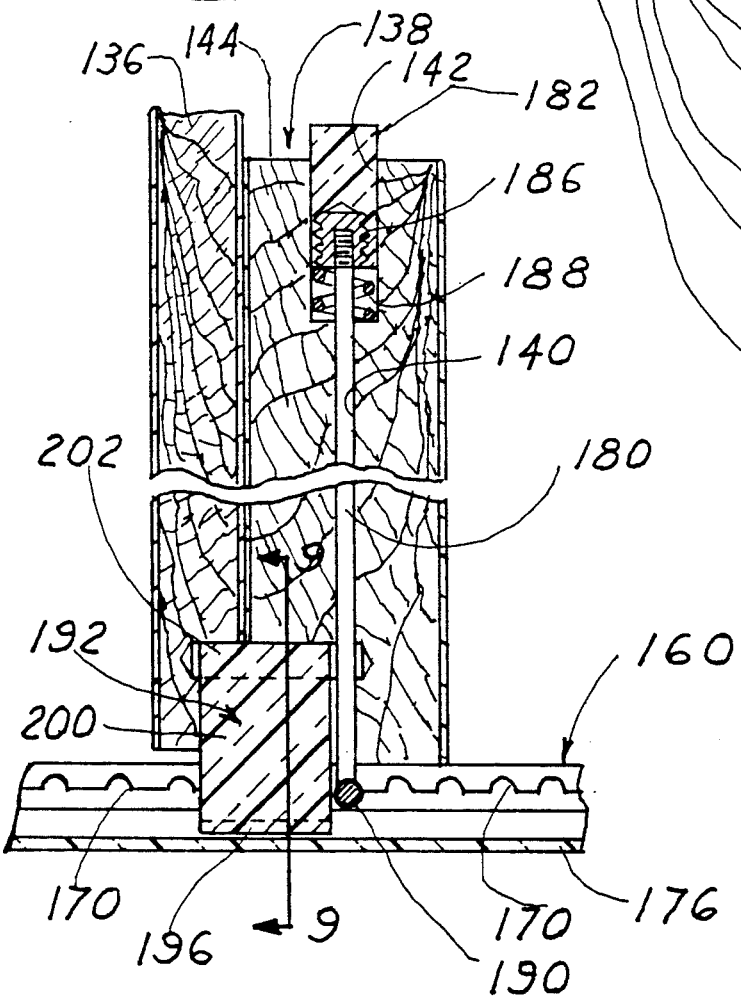
FIG. 8 is a cross sectional view generally taken along line 8—8 in FIG. 7.

As shown in FIG. 8, each base 138 includes a longitudinally extending bore 140 which terminates in an enlarged diameter end bore 142 adjacent a top surface 144 of each base 138. A transverse slot 146 with an enlarged, circular end 147 is formed adjacent a lower end of the base 138 and in the book support member 136. The slot 146 extends upward from the bottom surfaces of the base 138 and the book support member 136.

Figure 7:
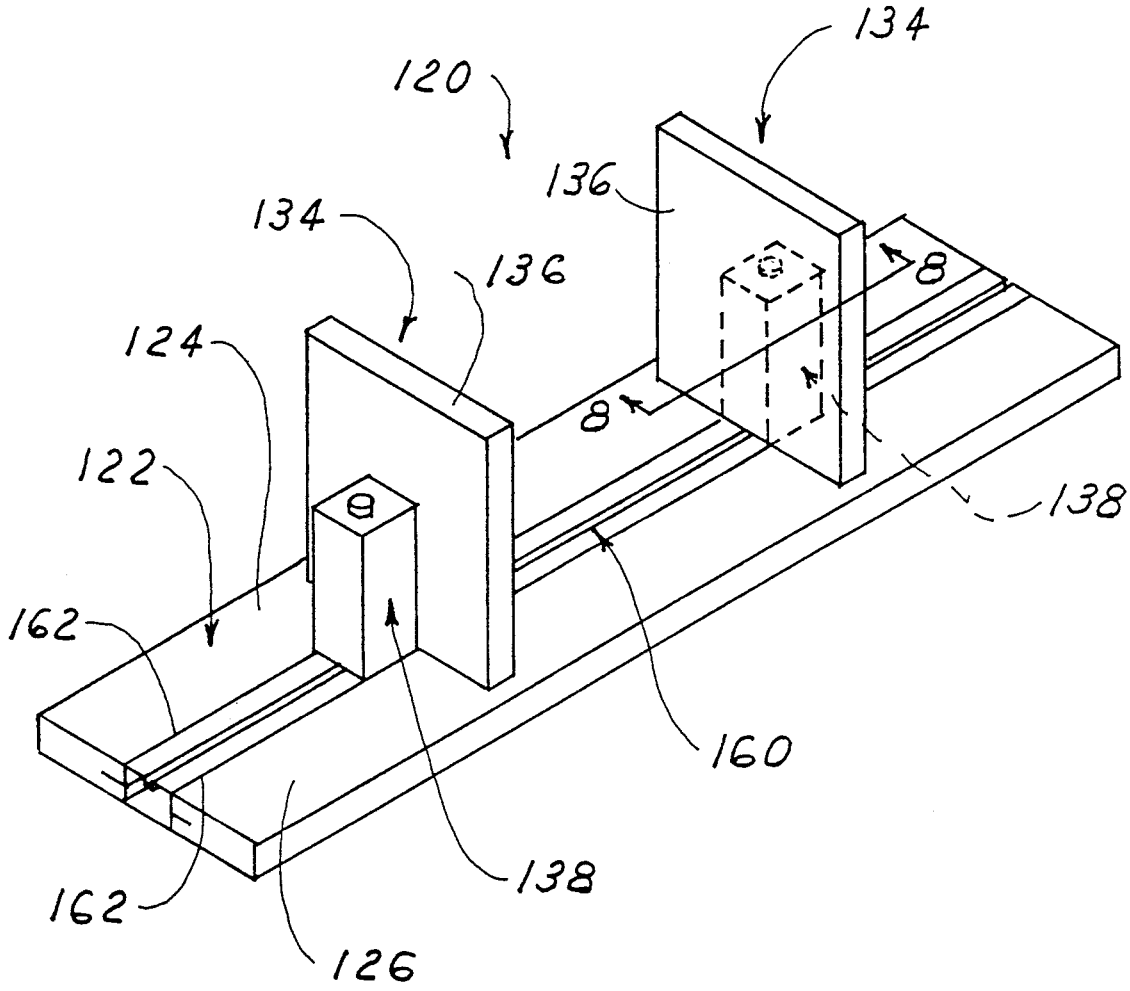
FIG. 7 is a perspective view of a third embodiment of the present invention.

A lock means is provided for releasably locking each of the bookends 134 in an adjustably selected position along the length of the shelf 122. As shown in FIGS. 7–9, and in greater detail in FIG. 10, the lock means includes a channel means 160 which fits between and interconnects the two shelf sections 124 and 126. The channel means 160 also provides a guideway for longitudinal movement and adjustable, locking positioning of each of the bookends 134.

Although the channel means 160 could be formed of any suitable metal, in a preferred embodiment, the channel means 160 is formed of an extruded plastic, such as polysulfone. Further, although the channel means 160 could be formed of a single, unitary member, in an exemplary embodiment, which is depicted by way of example only, the channel means 160 includes a pair of identical spine channels 162, each including an outer flange 164 and an inner, generally inverted U-shaped section 166 integrally connected thereto. An innermost leg 168 of the U-shaped section 166 is formed of an increased thickness and provided with a plurality of longitudinally spaced, generally arcuate shaped, open-ended apertures 170 which extend linearly in a generally horizontal plane in a normal bookshelf application.

The spine channels 162 are spaced apart to form a slot 170 therebetween when mounted to the respective shelf sections 124 and 126 as described hereafter.

Figure 10:
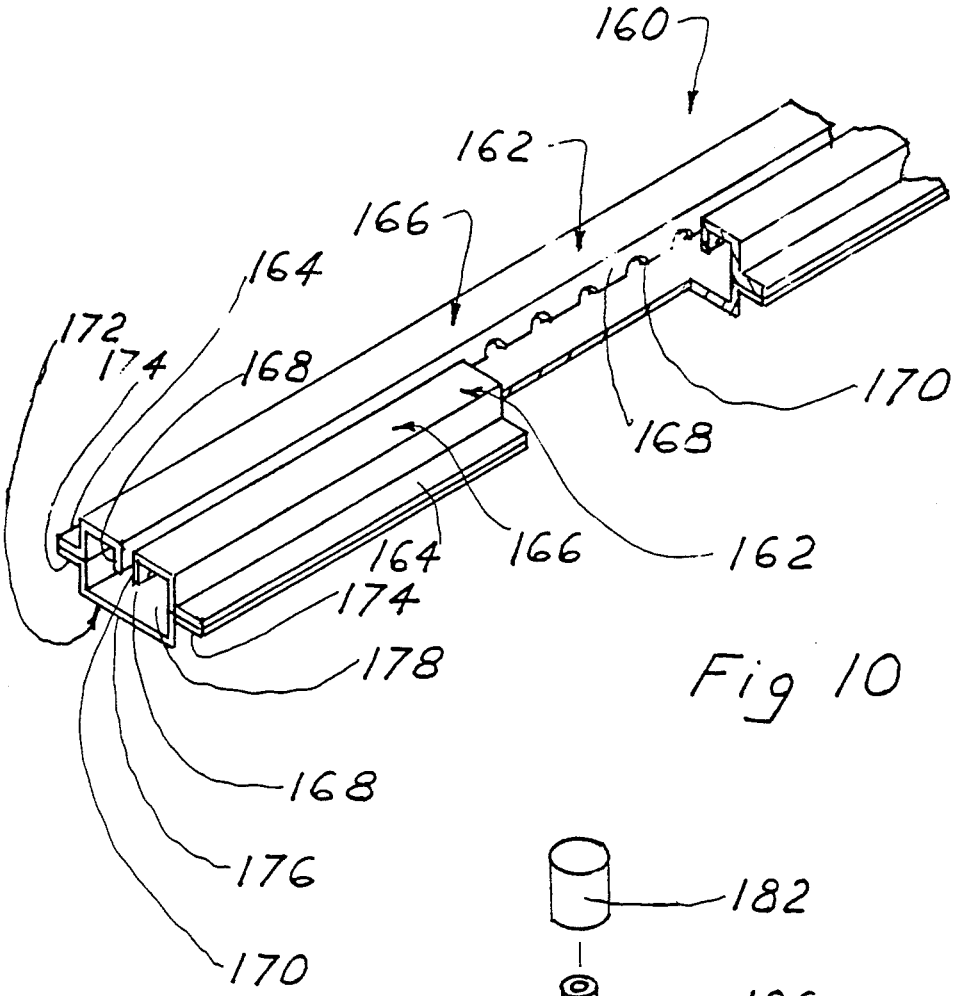
FIG. 10 is a perspective view of the channel employed in the third embodiment of the bookshelf shown in FIG. 7.

The channel means 160 also includes a link channel 172 having opposed outer legs 174 and a shallow U-shaped central portion 176 extending therebetween. The outer legs 174 of the link channel 172 are connected to the outer flanges 164 of the spine channels 162 by means of adhesive, thermal welding, fasteners, etc. This forms an interior, longitudinally extending cavity 178 extending along the length of the channel means 160, as shown in FIG. 10. The joined outer flanges 164 and outer legs 174 of the spine channels 162 and link channel 172 are inserted into the groove 132 formed on the inner side edge of each of the shelf sections 124 and 126 and joined thereto, preferably by means of a suitable, high strength adhesive. This arrangement joins the shelf sections 124 and 126 into a secure, unitary shelf structure as well as providing a longitudinally extending slot 170 along the length of the shelf 122.

Figure 11:
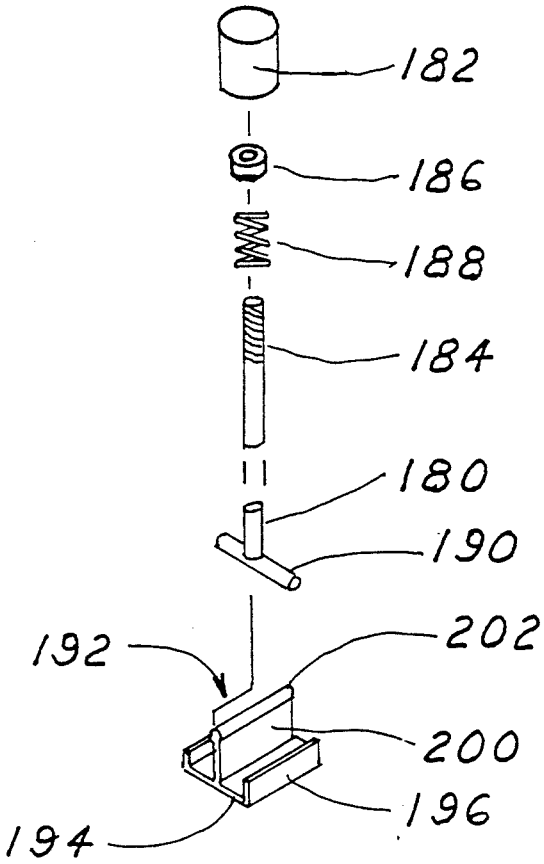
FIG. 11 is an exploded, perspective view showing the construction of another embodiment of a lock means employed in the third embodiment of the present invention.

The lock means of the present invention also includes an elongated lock bar 180, as shown in FIGS. 8 and 11. The lock bar 180 may be formed of any suitable material, such as steel wire. A manual release button 182, preferably formed of a plastic, is connected to the upper end of the lock bar 180 by threaded engagement with the threads 184 formed on the upper end of the lock bar 180 and an internally threaded metal insert 186 which is mounted in a small diameter bore formed in the manual release button 182. A biasing means, preferably in the form of a coil spring 188, is mounted in the enlarged bore 142 formed in the base 138 for normally biasing the manual release button 182 and the lock bar 180 in a generally vertical upward direction which defines the locked position of the bookends 134, as described hereafter. A metal cross bar 190 is joined to the opposite end of the lock bar 180 by suitable means, such as by welding, etc. The cross bar 190 extends laterally outward from the lock bar 180 and is designed to releasably engage the apertures 170 formed in the spaced spine channels 162.

A keeper formed of plastic and denoted generally by reference number 192 is mounted in the hollow cavity 178 extending along the channel means 160. The keeper 192 includes a generally U-shaped base formed of a center section 194 and two spaced, upwardly extending legs 196. The keeper 192 also includes an upwardly extending, centrally located stem 200 which is mounted on and extends vertically upward from the central section 194 of the base. An enlarged, circular cross section end 202 is formed on the upper end of the stem 200. The stem 200 and enlarged end 202 slidably fit within the slot 146 and enlarged end 147 formed in the base 138 and book support member 136 to mount the keeper 192 thereto.

In operation, with the keeper 192 slidably positioned with in the channel means 160 and the lock bar 180 mounted therein and extending upward through the base 138 to a connection with the manual release button 182, the biasing spring 188 will normally bias the manual release button 182 and, thereby, the lock bar 180 and the cross bar 190 in a generally upward direction bringing the cross bar 190 into engagement with an aligned pair of apertures 170 in the spaced spine channels 162. This locks the respective planar book support member 136 in a fixed position along the length of the shelf 122. However, a downward force exerted on the manual release button 182 will overcome the force of the biasing spring 188 and move the cross bar 190 out of engagement with the apertures 170 in the spine channels 162 thereby allowing sliding movement of the bookend 134 along the shelf 122 to the desired position at which time the manual release button 182 is released bringing the cross bar 190 into engagement with the apertures 170 and locking the bookend 134 in the desired position.

Figure 12:
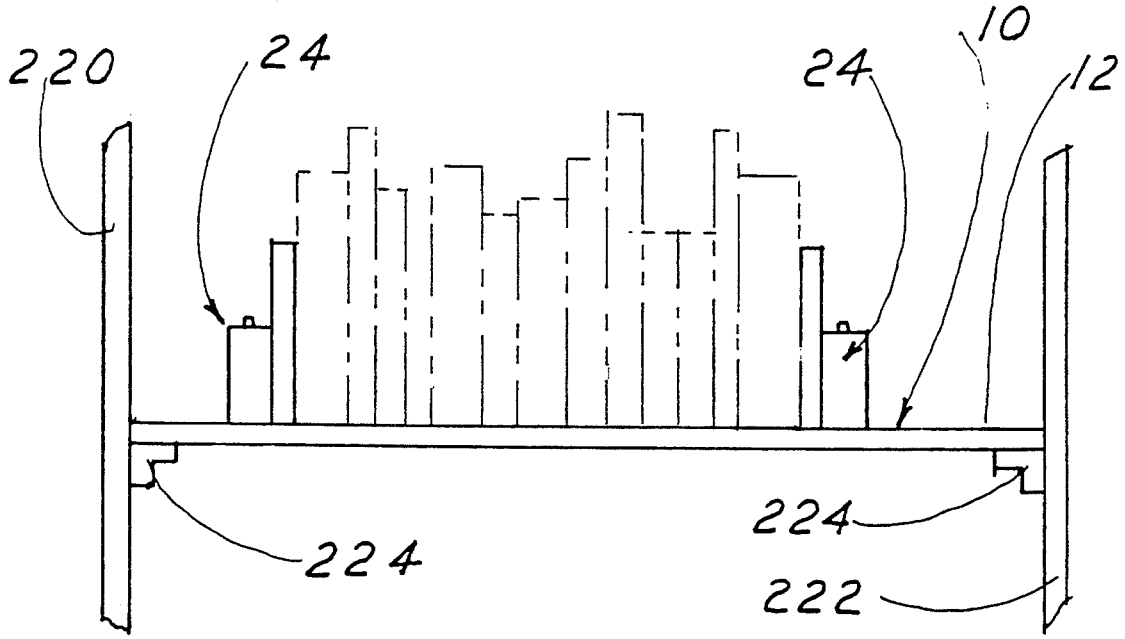
FIG. 12 is a front elevational view showing one mounting arrangement of the bookshelf with adjustable bookends of the present invention.
Figure 13:
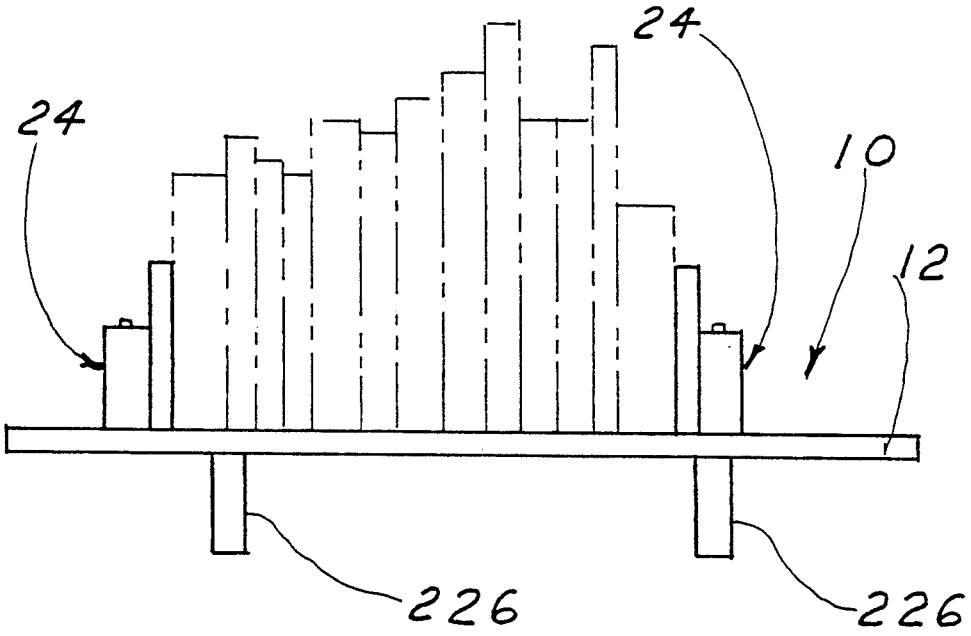
FIG. 13 is a front elevational view of another embodiment of the bookshelf with adjustable bookends of the present invention.

Referring now to FIGS. 12 and 13, there are depicted several embodiments illustrating exemplary uses of any of the bookshelves with adjustable bookends 10, 100 and 120, as described above. Although FIGS. 12 and 13 depict the use of the combined bookshelf with adjustable bookends 10 according to a first embodiment of the present invention, the other embodiments denoted by reference numbers 100 and 120 may also be likewise mounted for use in supporting books and the like.

In FIG. 12, the combined bookshelf with adjustable bookends 10 is mounted in a conventional bookcase having upstanding side walls 220 and 222. Conventional mounting brackets 224 are attached to the side walls 220 and 222 and support the outer ends of the shelf 12 in a removable manner. One or more bookends 24 may be mounted on the shelf 12 and slidably positioned to any location along the length of the shelf 12 to support a plurality of books shown in phantom in FIG. 12 therebetween. It will also be understood that only one bookend 24 may be employed to support a horizontal row of books between the one bookend 24 and one of the side walls 220 and 222 of the bookcase in which the combined shelf with bookends 10 is mounted.

In FIG. 13, the combined shelf with adjustable bookends 10 is illustrated as being mounted in a free-standing manner to a wall or other vertical surface by means of conventional wall mounting brackets 226. Such brackets 226 are secured to the wall and are disposed below and support the bottom surface of the shelf 12. In this embodiment, two bookends 24 are employed to support a plurality of books in a horizontal side-by-side arrangement on the shelf 12.

It will be noted that in either of the mounting embodiments shown in FIGS. 12 and 13, the shelf 10 may be removed from the bookcase or the mounting brackets 226 and moved to a different use location. This provides greater flexibility in the use of the present invention and would enable the convenient transportation of files, books, etc., between use locations and a final storage location in a bookcase or on the wall mounting brackets 226 shown in FIG. 13.

In summary, there has been disclosed a unique bookshelf with adjustable bookends which provide a simple, inexpensive, expedient means for supporting a plurality of books in a side-by-side arrangement between one and preferably two adjustably positionable bookends. The bookends are releasably lockable in a desired position along the length of the shelf to securely retain the books therebetween. The lock means employed on the bookends provides sufficient force to securely retain the bookends in the desired position on the shelf; yet, is releasable from the lock position by a low release force, such as finger pressure. The present invention has many uses, particularly a portable application where the shelf with adjustable bookends may be temporarily placed on any surface for use of the books or other material supported thereon prior to its subsequent mounting in a storage location, such as bookcase or on wall mounting brackets, etc.

What is claimed is:

1. A bookshelf with at least one adjustable bookend mounted thereon comprising:

a shelf having top and bottom surfaces;

an open guideway extending through the shelf and longitudinally along the shelf;

channel means, mounted on the shelf and having a longitudinally extending opening communicating with the guideway in the shelf, for forming a longitudinal slot along the shelf, the channel means including a pair of spine channels, each having first and second legs, the second leg spaced from the first leg and disposed adjacent one side of the guideway;

a plurality of spaced, open-ended apertures co-linearly formed in the second leg of each spine channel; and the second legs of the pair of spine channels being spaced apart to form the longitudinally extending opening therebetween aligned with the guideway in the shelf;

a link channel having a central wall formed between two spaced outwardly extending legs;

means for joining one of the legs of the link channel and the first leg of each spine channel to the shelf;

a book support member;

a base attached to the book support member;

lock means, mounted in the base and having a lock bar accessible at a first end for manual movement through the base, for releasably locking the base and the attached book support member in a selectively adjustable position along the length of the shelf;

a second end of the lock bar extending through the base and the guideway into the longitudinally extending opening in the channel means;

a cross bar mounted on the second end of the lock bar and releasably engageable with one of the apertures in the channel means to lock the book support member and the base in a selective position along the shelf; and biasing means, acting on the lock bar, for normally biasing the lock bar and the attached cross bar to a first position in which the cross bar engages one of the apertures in the channel means.

2. The bookshelf of claim 1 wherein the biasing means comprises a coil spring.

3. The bookshelf of claim 1 further comprising:

a manually engageable button mounted on the first end of the lock bar.

4. The bookshelf of claim 1 further comprising:

a bore formed in the base, the lock bar extending through the bore in the base.

5. The bookshelf of claim 1 further comprising:

first and second book support members, a base attached to each of the first and second book support members; and one lock means mounted in each base;

the first and second book support members being spaced from each other along the shelf, with the book support members facing each other on the shelf.

6. The bookshelf of claim 1 further comprising:

a low friction pad mounted on a bottom surface of the base.

7. The bookshelf of claim 1 wherein:

each of the pair of spine channels has a substantially L-shape;

the first leg of each of the pair of spine channels being fixedly mounted to the bottom surface of the shelf; and the guideway having opposed ends formed wholly within the shelf.

8. The bookshelf of claim 1 further comprising:

a plurality of fasteners mounted in a side edge of the first and second shelf members and extending outward therefrom to an enlarged head;

the fasteners extending through the first leg of each spine channel for mounting one of the spine channels to each of the first and second shelf members; and a plurality of generally L-shaped slots formed in the legs of the link channel, the slots being slidably engageable with the fasteners to releasably attach the link channel to the first and second shelf members.

9. The bookshelf of claim 8 further comprising:

biasing means, mounted about each fastener, for biasing the second leg of one of the spine channels and one of the legs of the link channel into secure engagement with the head of the fastener.

10. The bookshelf of claim 8 further comprising:

a lock fastener engageable with the side edge of one of the first and second shelf members and disposed in registry with an end of the link channel to fixedly lock the link channel in a horizontal position with respect to the one shelf member after the slots in the link channel have engaged the fasteners in the first and second shelf members.

11. The bookshelf of claim 1 wherein:

the channel means includes a pair of spaced spine channels, each having first and second perpendicularly disposed legs, the first leg of each spine channel being joined to the bottom surface of the shelf, the second leg of each spine channel having the open-ended apertures formed therein facing outward from the bottom surface of the shelf;

a keeper disposed below the bottom surface of the shelf and connected to the base; and biasing means, mounted between the keeper and the second end of the lock bar, for normally biasing the lock bar and the attached cross bar to a first position in which the cross bar engages one of the apertures in each of the spine channels.

12. The bookshelf of claim 11 wherein:

the guideway in the shelf comprises a slot having closed ends formed in and extending through the shelf.

13. A bookshelf with at least one adjustable bookend mounted thereon comprising:

a shelf formed of first and second shelf members spaced apart to form an open guideway therebetween;

the guideway extending through the shelf and longitudinally along the shelf;

channel means, mounted on the shelf and having a longitudinally extending opening communicating with the guideway in the shelf, for forming a longitudinal slot along the shelf, the channel means comprising:

upper and lower channel members, the upper and lower channel members being joined together and joined to each of the first and second shelf members; and the longitudinal slot formed in the upper channel member, the upper channel member including at least one downwardly extending leg adjacent to the slot, a plurality of spaced, open-ended apertures co-linearly formed in the downwardly extending leg;

a book support member;

a base attached to the book support member;

lock means, mounted in the base and having a lock bar accessible at a first end for manual movement through the base, for releasably locking the base and the attached book support member in a selectively adjustable position along the length of the shelf;

a second end of the lock bar extending through the base and the guideway into the longitudinally extending opening in the channel means;

a cross bar mounted on the second end of the lock bar and releasably engageable with one of the apertures in the upper channel member to lock the book support member and the base in a selective position along the shelf; and biasing means, acting on the lock bar, for normally biasing the lock bar and the attached cross bar to a first position in which the cross bar engages one of the apertures in the upper channel member.

14. The bookshelf of claim 13 wherein the upper channel member includes a pair of downwardly extending legs disposed on opposite sides of the slot, the open-ended apertures formed in each of the downwardly extending legs and arranged in aligned pairs.

15. The bookshelf of claim 13 wherein the upper channel member comprises:

a pair of identical members, each joined at an outer side portion to the lower channel member.

16. The bookshelf of claim 13 further comprising:

a keeper slidably mounted within the joined upper and lower channel members and having a centrally located stem extending through the slot in the upper channel member and the guideway in the shelf, the central stem joined to the base.

17. The bookshelf of claim 13 further comprising:

a manually engageable button mounted on a first end of the lock bar, the button being disposed in an enlarged end portion of a bore extending through the base and in which the lock bar is slidably disposed; and the biasing means comprises a coil spring mounted in the enlarged end portion of the bore in the base and acting on the manually engageable button to bias the manually engageable button and the attached lock bar to a first position.

18. The bookshelf of claim 13 wherein;

the guideway in the shelf and the channel means are each open at opposed ends.

19. A shelf comprising;

first and second shelf members spaced apart to form an open guideway therebetween, the guideway extending through the shelf and longitudinally along the first and second shelf members;

channel means, mounted on the first and second shelf members and having a longitudinally extending opening communicating with the guideway for forming a longitudinal slot along the first and second shelf members, the channel means comprising;

upper and lower channel members, the upper and lower channel members being joined to each of the first and second shelf members; and the longitudinal slot formed in the upper channel member, the upper channel member including at least one downwardly extending leg adjacent to the slot, a plurality of spaced, open-ended apertures co-linearly formed in the downwardly extending leg;

article support means, slidably moveable along the shelf, for supporting an article on the shelf;

lock means, mounted in the article support means and having a lock bar accessible at a first end for manual movement through the article support means, for releasably locking the article support means in a selectively adjustable position along the length of the first and second shelf members;

a second end of the lock bar extending through the article support means and the guideway into the channel means;

a cross bar mounted on the second end of the lock bar and releasably engageable with one of the apertures in the upper channel member to lock the article support means in a selective position along the first and second shelf members; and biasing means, acting on the lock bar, for normally biasing the lock bar and the attached cross bar to a first position in which the cross bar engages one of the apertures in the upper channel member.

* * * * *